US006122925A

United States Patent [19]

Rawlins

[11] Patent Number: 6,122,925

[45] Date of Patent: Sep. 26, 2000

[54] INSULATION SYSTEM FOR OUTDOOR ICE RINK

[76] Inventor: John Alan Rawlins, 2638 Eastwood Ave., Richland, Wash. 99352

[21] Appl. No.: 09/109,370

[22] Filed: Jul. 2, 1998

[51] Int. Cl.[7] ..... F25C 3/02

[52] U.S. Cl. ..... 62/235; 165/135; 472/92

[58] Field of Search ..... 62/235; 165/135; 472/92

[56] References Cited

U.S. PATENT DOCUMENTS

| | | | |
|---|---|---|---|
| 3,983,713 | 10/1976 | MacCracken | 62/235 |
| 4,164,047 | 8/1979 | Barothy | 4/172 |
| 4,531,511 | 7/1985 | Hochberg | 165/135 |
| 4,598,506 | 7/1986 | Nohl | 52/66 |

*Primary Examiner*—William E. Tapolcai
*Attorney, Agent, or Firm*—Floyd E. Ivey

[57] ABSTRACT

The invention is an insulation system that enables the ice sheet of a skating rink to be economically established and maintained outdoors even at relatively high ambient temperatures. A part of the insulation system is a removable cover member that can be raised and lowered. The cover is raised to allow access to the ice and can serve much as a patio cover in this position. In the lowered position the cover forms a surface similar to a deck attached to a domestic dwelling and enables the area occupied by the ice rink to be used for other purposes when it is not being used for ice-related activities. The embodiment described is directed to residential use outdoor. The invention can be adapted for commercial use and for indoor use.

7 Claims, 3 Drawing Sheets

INSULATION SYSTEM FOR OUTDOOR ICE RINK

BACKGROUND OF THE INVENTION

1. Field of the Invention

The present invention relates generally to insulation systems for ice rinks and in particular to insulation systems for outdoor ice rinks.

2. Description of Related Art

The immediate and obvious obstacle to establishing and maintaining an ice sheet year round, outdoors, is the heat load on the ice in warm weather and the consequent impractical economic burden. Thus, though the ability to conveniently, and economically continue ice skating activities, at will, through the summer months, without the expense of constructing and maintaining an enclosing structure for the ice rink would be of obvious benefit both to recreational skaters and to professionals, back yard skating rinks are not as prevalent in most areas as are swimming pools or tennis courts.

However, attempts have been made to provide practical outdoor skating rinks which are usable year around. MacCracken (U.S. Pat. No. 3,983,713) reveals a method for creating an outdoor ice slab in summer weather. The method is aimed at reducing radiation heat gain by suspending a layer of aluminum foil over the ice rink at about the same level as is a roof over the rink, and upon painting a layer of the ice sheet white. The method leaves the ice sheet substantially open to the ambient at all times.

An outdoor ice rink is obviously susceptible to being sullied by dust and debris if left open to the ambient. An effective insulation system that also provides a means to cover the ice, significantly reduces this exposure. Further, such a cover, if structurally adequate, also provides a means to put the area occupied by the ice sheet to alternate uses when the ice is not being used. An appropriately designed cover can be an effective barrier to conduction and convection heat loads. At the same time a cover can reduce the radiation heat load on the ice. A cover can thus insulate against all of the heat load mechanisms. In warm, windy weather, a cover may be essential to maintain an ice sheet. Provision of a cover, then, could increase the availability and utility of an outdoor rink both in commercial and in residential applications.

The use of deck-like covers to protect recreational facilities as well as to provided for alternate uses of the area occupied, is revealed in the art related to swimming pools. One such cover is revealed by Barothy ( U.S. Pat. No. 4,164,047). The cover is structurally strong enough to support activities such as table tennis, dancing, etc. Barothy's invention is specifically directed towards indoor pools. Nohl, et al (U.S. Pat. No. 4,598,506) reveal a deck-like cover for use with indoor and outdoor swimming pools capable of supporting recreational activities. Swimming pools are typically left open at the surface much of the time. It is not critical to the existence of the pool that an insulating cover be provided. Swimming pools covers are therefore, designed to protect and to have structural strength but are not aimed at providing a significant and specific degree of insulation against heat transfer. In application over an outdoor ice-rink, however, a cover which is not specifically designed to have a high insulation capacity would not serve to establish and maintain the ice sheet.

The patents mentioned above are provided herewith in an Information Disclosure Statement in accordance with 37 CFR 1.97.

SUMMARY OF THE INVENTION

The present invention is an insulation system for outdoor ice rinks that permits the ice sheet to be formed and maintained using a refrigeration unit of relatively low refrigerating capacity operating at a reasonable duty cycle, while at the same time providing a means of utilizing the surface area taken by the ice sheet for other purposes when desired. These features provide for a system that can be installed at a relatively low cost, maintained and operated economically and does not demand the dedicated use of the large space typically occupied by an ice rink. Thus the system makes it feasible to install an outdoor ice rink at locations wherein such installations were heretofore inconceivable due to the limitations imposed by cost and space.

The elements of the invention are an insulating sidewall running around the periphery of the ice sheet and a removable insulating cover that when placed over the sidewall serves to close the space between the cover and the ice below it. The cover can be raised or removed to gain access to the ice. This can be done manually. Alternatively, means can be incorporated to mechanically raise and lower the cover over the sidewall and ice sheet. The cover is constructed to have sufficient structural strength such that when it is resting upon the sidewall, various general activities can be carried out on its exposed surface much as would be carried out upon the typical decks attached to residential dwellings. When the cover is in its raised position it can serve in the fashion of a patio cover providing similar protection from the elements while permitting access to the ice. Whilst these are the principal utilities of the invention, various features, some of which are described below, can be incorporated into the system to increase its utility.

The system has been found to permit the ice sheet to be maintained and used at ambient temperatures greater than 70 degrees Fahrenheit for extended periods. For economical use it is envisaged that the system will be used during the cooler portions of the day, the system merely maintaining the ice sheet during the warmest periods of the day, typically, the afternoons.

The invention is intended for use with ice rinks over a wide range of sizes from individual domestic use to commercial applications. The invention, in one of its embodiment, and several additional features, are described below.

DETAILED DESCRIPTION

Figure 1:
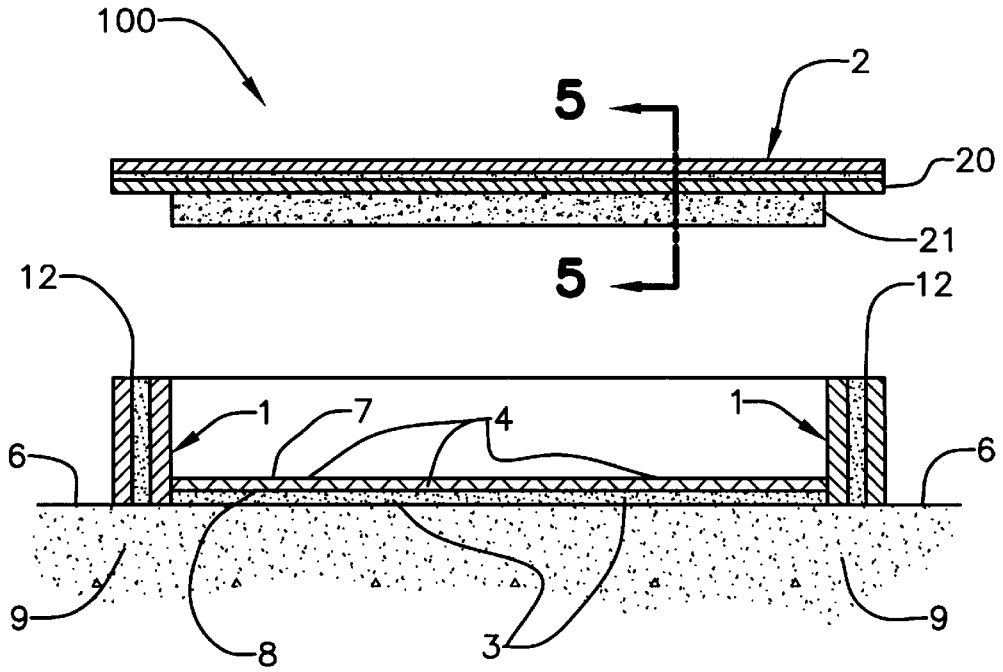
FIG. 1 is a cross-sectional view of an embodiment of the Insulation System for Outdoor Ice Rink, 100, showing the insulating sidewall, 1, the removable insulating cover, 2 and the ice sheet, 4, laid upon a layer of sand, 3, the sand layer, 3, in turn, resting upon the surface, 6, of the earth, 9. The cross-section can be conceived of as being taken on a vertical plane through the mid-point of an oval or rectangular outdoor ice rink insulated with the Insulation System for Outdoor Ice Rink, 100, though the system is applicable to ice rinks of any shape. The upper and lower surfaces of the ice sheet, 4, are respectively designated 7 and 8. As also depicted in FIG. 1, the cover, 2, comprises an insulating section, 20, and a reinforcing section, 21.

The primary objective of the present invention is to provide an insulation system which enables an outdoor ice rink to be economically established and maintained even when the ambient temperature is relatively high and in the range typical of summer, while at the same time permitting other uses of the area occupied by the ice rink when the ice rink is not being used. It is envisaged that the invention will enable ice rinks to be established at individual residential dwellings, for group use such as at recreational clubs and in commercial enterprises.

The following description addresses one embodiment of the invention. However, the invention may be realized in other embodiments and with a number of variations, all of which follow from the inventive concept of the invention. The following description is not intended to exclude these other embodiments and variations from the scope of the present invention.

The description of the system is offered with reference to the drawings, FIG. 1 through FIG. 5, with the various elements of the system being numbered alike in the description and in the drawings.

FIG. 1 is a cross-sectional view of the Insulation System for Outdoor Ice Rink, 100, as manifested in the embodiment described below and shows the primary elements of the invention namely, an insulating sidewall, 1, and a removable insulating cover, 2. The cover is so shaped that it can removably rest upon the upper surface, 12, of the sidewall, 1, and thereby enclose a space between itself, the sidewall and the upper surface, 7, of the ice sheet, 4. When the ice sheet is not in use, the cover is to be placed upon the sidewall thereby creating an insulating barrier around the ice. The cover is raised or removed to provide access to the ice.

The sidewall, 1, is placed so that it surrounds and defines the outdoor area over which the ice sheet, 4, is established, and such that it is in close proximity to the peripheral edge of the ice sheet. While the ice sheet may be established within the confines of the sidewall using any means, in the embodiment realized, the ice sheet, 4, was formed as follows: cooling coils connected to a nominally three-ton capacity household refrigeration system were laid as a flat grid on the surface of the outdoor area, the coils being surrounded and covered by a layer of sand, 3. The refrigeration unit was operated and when the sand had cooled to the appropriate temperature, water was sprayed on the sand to establish the ice sheet. Additional amounts of water were sprayed to build the ice layer to the desired thickness.

Figure 2:
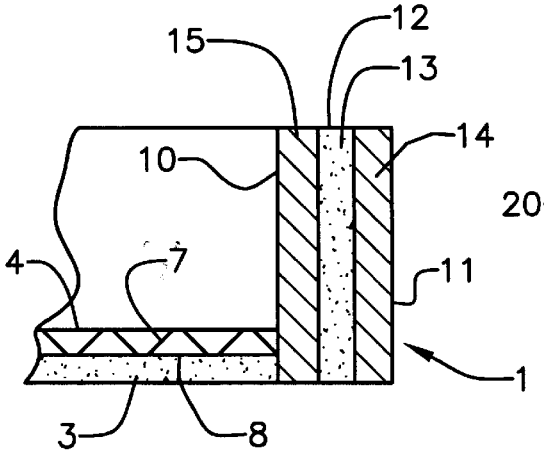
FIG. 2 is a cross-sectional view of the sidewall taken in a vertical plane across its thickness, showing the free, generally flat, horizontal, upper surface, 12, and the components 13, 14 and 15 of the sidewall in one embodiment. The inner and outer faces of the sidewall are indicated by 10 and 11, respectively.

FIG. 2 is a cross-sectional view of the sidewall taken in a vertical plane across its thickness and shows the surfaces of the sidewall forming its inner face, 10, and its outer face, 11, extending generally vertically upwards from a level below the lower surface of the ice sheet, 8, to a level above the upper surface of the ice sheet, 9. The inner and outer face of the sidewall end at, and define between them, a free, generally flat, horizontal, upper surface, 12, of the sidewall. The sidewall has insulating means such as fiber glass insulation and means to provide structural strength, such as wooden studs. For example, as also shown in FIG. 2, the sidewall may be constructed as a sandwich of an insulating layer, 13, comprising material chosen primarily for insulating ability, held between structural layers, 14 and 15, comprising materials chosen primarily for structural strength, weather resistance and moisture resistance. The exposed faces of the structural layers form the inner and outer faces, 10 and 11 respectively, of the sidewall. In the embodiment realized, the insulating layer, 13, comprised a material known in the trade as Foam Board, which predominantly comprises polymeric material and the structural layers, 14 and 15, each comprised a wood-derived material known in the trade as Oriented Strand Board or alternatively as OSB. In the embodiment realized, the sidewall comprising these materials offered an insulation value of at least R-8 in the horizontal plane across its thickness.

Figure 3:
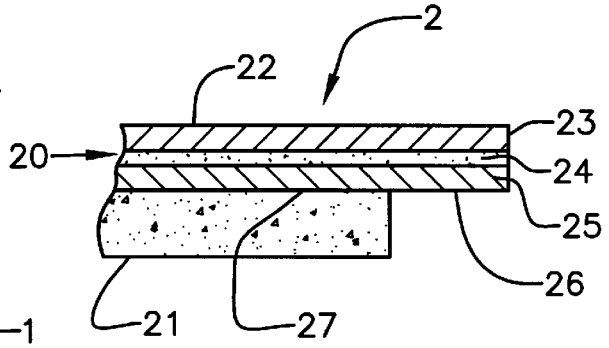
FIG. 3 is a cross-sectional view of the cover, 2, taken at a typical vertical plane 5—5 in FIG. 1, and depicts the elements 23, 24 and 25, of the insulating section, 20, of the cover in one embodiment.

As noted above, the sidewall, 1, functions in conjunction with a cover, 2, to form the Insulation System for Outdoor Ice Rink, 100. FIG. 3 is a cross-sectional view of the cover taken at a typical plane 5—5 in Fig A, and depicts the elements of the cover in one embodiment.

The cover comprises two sections, an insulating section, 20, having insulating means such as fiber glass, and a reinforcing section, 21, having means to provide structural strength, such as wooden studs. As in the case of the sidewall, the insulating section, 20, of the cover may be a sandwich of an insulating layer, 24, comprising material chosen primarily for insulating ability, held between structural layers, 23 and 25, comprising materials chosen primarily for structural strength, weather resistance and moisture resistance. As in the case of the sidewall, in the embodiment realized, the insulating layer, 24, comprised a material known in the trade as Foam Board, which predominantly comprises polymeric material, and the structural layers, 23 and 25, each comprised the wood-derived material known in the trade as Oriented Strand Board or as OSB.

The cover was constructed in rectangular sections of about 4 feet by 8 feet. The sections were joined using tongue-and-groove joints. The exposed face of the structural layer, 23, forms the generally flat upper surface, 22, of the cover. The upper surface of the cover is painted to present a light grey to white aspect such that incident radiant energy is substantially reflected back to the ambient. In the embodiment realized, the cover comprising these materials offered an insulating value of at least R-32 perpendicularly across the thickness of the cover.

The reinforcing section, 21, provides the structural strength to the cover, 2. In general, the structural strength afforded by the reinforcing section, in conjunction with the flat upper surface, 22, allows the cover to constitute a surface that is usable as a deck upon which other activities may be carried on when the ice sheet is not being used. In the embodiment realized, the reinforcing section, 21, comprised commercially available 9.5 inch deep wooden joists, the joists being shaped as I-beams constructed primarily of plywood webs bonded to wood flanges. The I-beams were placed in a rectangular box formation below the insulating section with additional I-beams used as crosspieces to provide the required structural strength to the cover. The spaces between the I-beams were filled with fibre insulation bats such that the reinforcing section also provided additional insulation of at least R-20 in the vertical plane across its thickness.

Further, in the embodiment realized the system was applied to a generally rectangular outdoor ice sheet about 30 feet long and about 20 feet wide. The system has been found to permit the ice sheet to be maintained and used at ambient temperatures above 70 degrees Fahrenheit for extended periods. The refrigeration unit required about four days of continuous operation to establish the ice sheet. Thereafter, the refrigeration unit operated about four hours per day to maintain a temperature of 27 degrees Fahrenheit two inches below the surface of a four inch deep ice sheet. Since the typical ice thickness required is one to two inches instead of four inches, the system can be operated more economically. For economical use it is also envisaged that the system will be used during the cooler portions of the day, the system merely maintaining the ice sheet during the warmest periods of the day, such as the afternoons.

Figure 4:
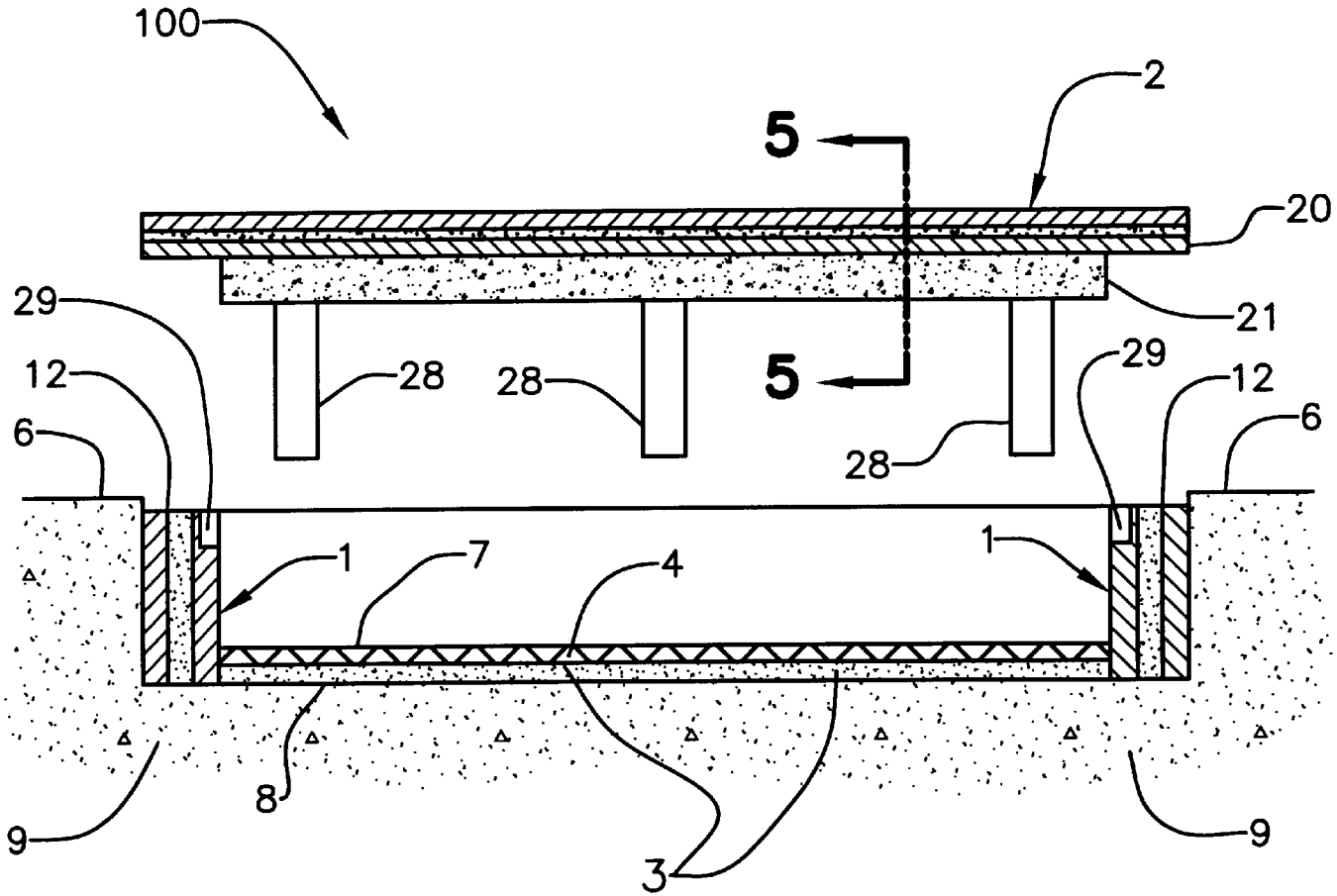
FIG. 4 is a cross-sectional view of an embodiment of the Insulation System for Outdoor Ice Rink, 100, showing additional features that may be included to enhance the utility of the system. Support legs, 28, may be affixed to the cover, 2, to provide additional structural support. Means for spraying fluid to build or maintain the ice sheet, 4, such as spray heads, 29, may be incorporated in the sidewall, 1.

It is to be noted that while the embodiment of the invention shown in FIG. 1 is depicted as being constructed on the surface, 6, of the Earth, 9, in one variation of the present invention, shown in FIG. 4, the ice sheet, 4, may be placed at the bottom of a pit in the earth, such that, when the cover, 2, is placed upon the sidewall, 1, the upper surface of the cover, 22, is level with the surrounding surface of the earth, 6.

In the embodiment realized the cover was constructed to have a lip around its periphery, with the lip having a generally flat lower surface, 26, all around its periphery such that when the ice sheet was covered the flat lower surface, 26, of the lip rested upon the flat upper surface, 12, of the sidewall. Therefore, in the embodiment realized the height of the sidewall above the ice surface was dictated in part by the fact that the reinforcing section, 21, of cover, which extends about one foot below the lower surface, 27, of the insulating section, had to be kept from touching the ice sheet. In some cases, such as in smaller ice rinks or in ice rinks of certain shapes, the cover may be inherently of such structural strength that the reinforcing section may have smaller dimensions or may be eliminated altogether. In such cases the height of the sidewall above the ice sheet may be significantly reduced. Contrarily, in applications involving particularly large ice rinks or ice rinks of certain other shapes, additional reinforcing supports may be provided to the cover in the form of vertical support legs, 28 (FIG. 4), extending downwardly from the cover and resting upon the ice sheet, enabling the deck-like cover to be used irrespective of the size of the rink.

Figure 5:
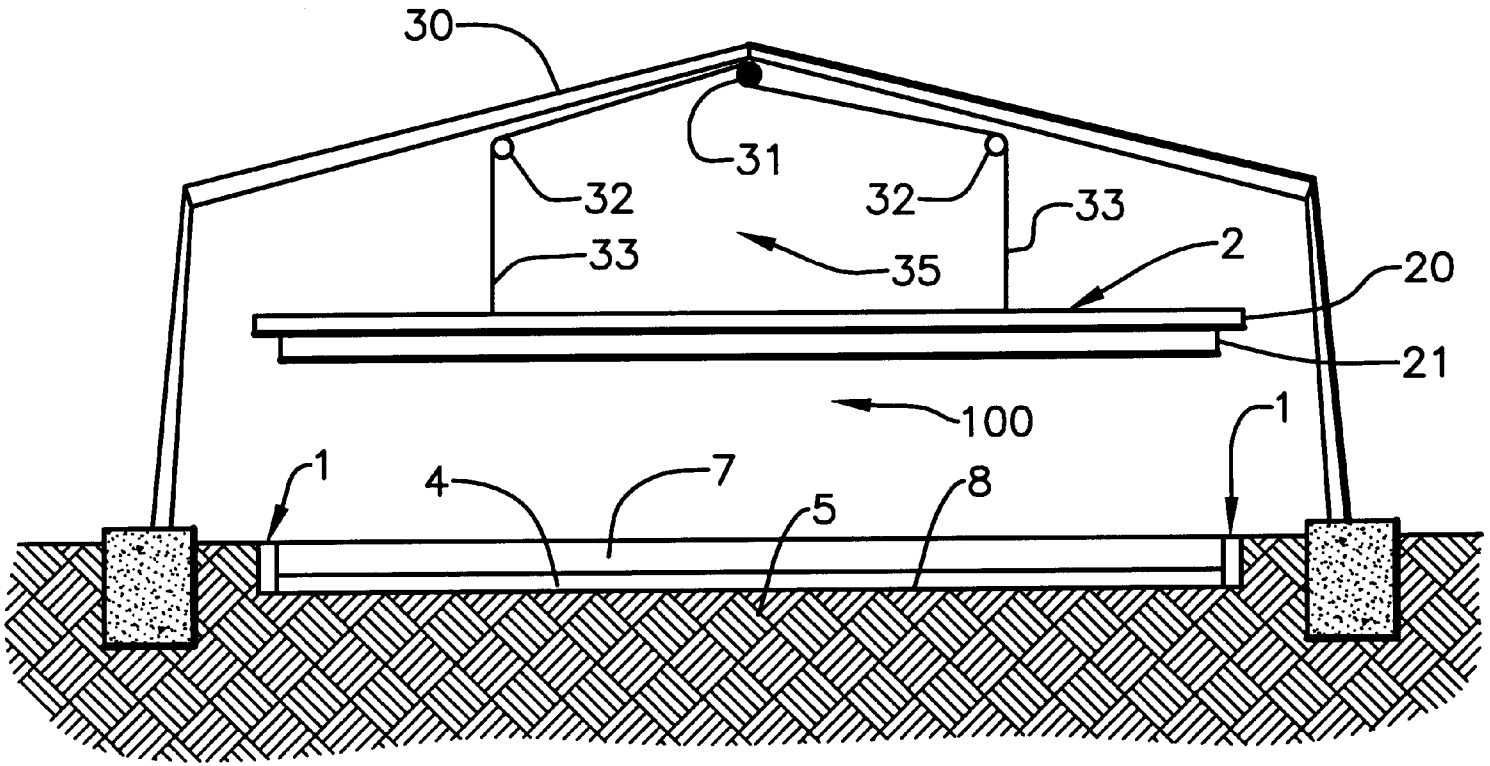
FIG. 5 is a cross sectional elevation of the Insulation System for Outdoor Ice Rink, 100, depicting one embodiment of means to mechanically raise and lower the cover, 2. This means is designated 35, and comprises an electric motor, 31 affixed to a truss, 30; pulleys, 32, and ropes 33. It is to be noted that in this figure the sand layer, 3, is not depicted, though it may be present.

It is also envisaged that in another aspect of the invention power-assisted means are provided to mechanically raise and lower the cover over the ice sheet. The elements comprising the raising and lowering means, 35, in one embodiment are illustrated in FIG. 5, wherein the electric motor, 31, pulleys, 32 and ropes, 33, of the raising and lowering means are shown suspended from the roofing truss of a steel-frame enclosure, 30. The same means can be used to temporarily lock the cover in place when in the raised position, so that the physical effort in removing the cover is eliminated while enabling the cover to serve in the manner of a patio cover in the raised position.

One objective of the invention being to enable the economic establishment of an outdoor ice sheet, it is also envisaged that in yet another aspect of the invention, spray heads, 29 (FIG. 4) be provided in the sidewalls to spray the water required to form the ice sheet. The ice sheet can then be established while the cover remains in place over the sidewall, thus reducing the energy required to establish the ice sheet.

The invention can also be adapted for use with existing indoor or outdoor commercial ice rinks to reduce energy consumption. Many existing ice rinks are already equipped with moveable floors and with sidewalls such as hockey dasher boards. In these instances, the moveable floors can be adapted to serve as the cover in the present invention and flexible side insulating members can be provided as a seal between the moveable floors and the dasher boards.

Thus, while a particular embodiment of the present invention has been shown and described, it will be apparent to those skilled in the art that many changes and modifications may be made without departing from the invention in its broader aspects and that the critical factor is that the sidewall and cover, each posses adequate insulating capacity and structural strength. The appended claims are therefore intended to cover all such changes and modifications as fall within the true spirit and scope of the invention.

I claim:

1. An insulation system for outdoor ice rink comprising:

an insulating sidewall; the sidewall having insulating means; the sidewall continuously surrounding an ice sheet and being in close proximity to the peripheral edge of the ice sheet, the sidewall extending generally vertically upwards from a level below the lower surface of the ice sheet to a level higher than the upper surface of the ice sheet; the sidewall having a free, generally flat, horizontal, upper surface;

a removable insulating cover; the cover having insulating means; the cover having an upper surface, the upper surface of the cover being nominally flat and painted to a color offering high reflectivity to radiant energy incident on the cover from the ambient; the cover being constructed to have such dimensions that it can rest upon the free, generally flat, horizontal, upper surface of the sidewall and thereupon define, in conjunction with the sidewall, a generally closed space above the surface of the ice sheet;

the sidewall, in combination with the cover resting upon the sidewall, providing such degree of insulation to the ice sheet, as to enable the continuance of the ice sheet at ambient temperatures typical of the summer season.

2. The insulation system for outdoor ice rink of claim 1, wherein:

the cover is constructed to have such structural strength that when it is resting upon the sidewall, various recreational activities can be carried out upon the generally flat upper surface of the cover.

3. The insulation system for outdoor ice rink of claim 2 further comprising:

means for raising and lowering the cover and means for locking the cover in its raised position.

4. The insulation system of claim 3 wherein:

support legs are affixed to the lower surface of the of the cover, the support legs extending downwardly from the lower surface of the cover and resting upon the ice surface when the cover is resting upon the sidewall, so as to increase the load bearing ability of the cover.

5. The insulation system for outdoor ice rink of claim 3 wherein:

foldable material is attached to the cover so as to depend downward from the cover when the cover is raised, thereby forming a curtain around the ice rink.

6. The insulation system for outdoor ice rink of claim 3 wherein:

means for spraying water are incorporated in the sidewall whereby water can be sprayed as required to create or maintain the ice sheet.

7. The insulation system for outdoor ice rink as in claim 3 further comprising:

a lighting system incorporated in the cover thereby enabling the ice rink to be used when adequate natural light is unavailable.

* * * * *